US006739935B2

(12) United States Patent
Van Teunenbroek et al.

(10) Patent No.: US 6,739,935 B2
(45) Date of Patent: May 25, 2004

(54) TOY ARTICLE

(75) Inventors: Ronald Van Teunenbroek, Amsterdam (NL); Robertus Maria Sluijs, Castricum (NL)

(73) Assignee: Breakey B.V., Castricum (NL)

( * ) Notice: Subject to any disclaimer, the term of this patent is extended or adjusted under 35 U.S.C. 154(b) by 0 days.

(21) Appl. No.: 09/769,100

(22) Filed: Jan. 25, 2001

(65) Prior Publication Data

US 2001/0009837 A1 Jul. 26, 2001

(30) Foreign Application Priority Data

Jan. 26, 2000 (NL) ..... 1014184

(51) Int. Cl.[7] ..... A63H 33/00

(52) U.S. Cl. ..... 446/69; 273/451; 446/124; 446/491

(58) Field of Search ..... 446/69, 124, 125, 446/486, 491; 273/440, 451, 452, 156, 153 R; 59/80, 82, 91

(56) References Cited

U.S. PATENT DOCUMENTS

| | | | | | |
|---|---|---|---|---|---|
| 2,169,265 | A | * | 8/1939 | Mantz | 59/91 |
| 2,674,842 | A | * | 4/1954 | Hess | 59/80 |
| 3,005,282 | A | | 10/1961 | Christiansen | |
| 3,413,752 | A | * | 12/1968 | Perry | 24/594.11 |
| 3,514,893 | A | * | 6/1970 | Pasky | 16/281 |
| 3,667,153 | A | * | 6/1972 | Christiansen | 446/124 |
| 3,733,852 | A | * | 5/1973 | Johnson et al. | 63/37 |
| 3,792,858 | A | * | 2/1974 | Cross et al. | 273/440 |
| 4,039,185 | A | * | 8/1977 | Rhodes | 273/451 |
| 4,582,447 | A | * | 4/1986 | Itoh | 206/821 |
| 4,781,038 | A | * | 11/1988 | Branca et al. | 63/26 |
| 4,886,270 | A | | 12/1989 | Arenson et al. | |
| 4,947,527 | A | * | 8/1990 | Hennig | 24/586.11 |
| 5,035,667 | A | * | 7/1991 | Haley | 24/116 A |
| 5,069,028 | A | * | 12/1991 | Fornaini | 59/80 |
| 5,169,149 | A | * | 12/1992 | Pepa | 273/156 |
| 5,531,625 | A | * | 7/1996 | Zhong | 446/120 |
| 5,769,426 | A | * | 6/1998 | Gill | 273/452 |

FOREIGN PATENT DOCUMENTS

| | | |
|---|---|---|
| FR | 508253 | 10/1920 |
| GB | 519560 | 3/1940 |
| JP | 60-162476 | 8/1985 |
| JP | 09-010444 | 1/1997 |

* cited by examiner

*Primary Examiner*—Derris H. Banks
*Assistant Examiner*—Bena B. Miller
(74) *Attorney, Agent, or Firm*—Knoble & Yoshida LLC

(57) ABSTRACT

The invention relates to a toy article which is, among other things, suitable as a collector's item and/or for use in games which toy article comprises a handle and a coupling piece for effecting a connection with a second toy article, which coupling piece is attached to said handle via a connecting element, which gives way when a predetermined force or torque is exerted thereon.

21 Claims, 2 Drawing Sheets

TOY ARTICLE

The invention relates to a toy article which is among other things suitable as a collector's item and/or for use in games, which toy article comprises a handle.

Such a toy article is known per se and is for example added to boxes of cornflakes or to bags of potato crisps. A very well-known example of such a toy article is the so-called flippo®. This is a round disc of for example laminated cardboard or plastic on which a picture is printed and which among other things is used as a collector's item for children and as an aid in playing games. An object of the invention is to provide a toy article of the kind referred to in the preamble which offers additional possibilities, in particular with regard to playing games.

In order to accomplish that objective, the toy article according to the invention is characterized by a coupling piece for effecting a connection with a second toy article, which coupling piece is attached to said handle via a connecting element, which gives way when a predetermined force or torque is exerted thereon.

Such a toy article can be coupled to a second toy article by the user, which second toy article may be identical to the first toy article. Then one user or both users can generate a force or a torque until the connecting element in one of the two toy articles gives way. Thus it becomes possible to play a game or a match, of which for example the user of the toy article whose coupling piece has not given way is held to be the winner.

It is preferable for the connecting element to give way by breaking loose at a predetermined force or torque. The toy article from which the connecting element has broken loose is visibly defective in that case and can no longer form part of the population of potentially participating specimens. Moreover, the coupling piece that has broken loose and/or the handle may serve as a trophy for the winner of the game.

When the part of the coupling piece that is intended to be coupled to a second toy article is shaped to be able to be coupled to a coupling piece that is identical in shape, the toy articles that form part of the aforesaid population can all have an identical shape. This has advantages from a production point of view, since only one mould or set of moulds will be required in that case. In addition, every owner of such a toy article will be able to play a game or a match with every other owner.

A very suitable embodiment is one wherein the part of the coupling piece that is intended to be coupled to a second toy article comprises a projection and a cavity that is complementary to said projection. It has become apparent that when such a configuration is used, the first and the second toy article can easily be fitted together, and that in addition it is possible to exert a sufficiently large force or torque on the connecting element or the connecting elements. If the projection is moreover wedge-shaped, the coupling pieces will interlock when a connection is being effected, so that the coupling piece of one toy article will remain connected to the coupling piece of the other toy article after one of the connecting elements has given way, and it can be released at a later stage.

Furthermore it is preferably for the coupling piece to be connected to the handle or to the connecting element by means of a once-only snap connection. Such a snap connection can be easily effected and it can only be broken by visibly and permanently damaging at least one of the parts that are involved in the connection.

In one preferred embodiment of the toy article according to the invention the coupling piece or the handle comprises a cylindrical portion, by means of which it is fixed in a cylindrical cavity in the handle or in the coupling piece, respectively. When such an embodiment is used, a torque that is generated can be effectively transmitted to the connecting element. With such a toy article the connecting element is preferably fixed to the wall or to the bottom of the cylindrical cavity.

Furthermore it is preferred that there is a certain amount of play between the coupling piece on the one hand and the connecting element and/or the handle on the other hand. Since said play allows some freedom of movement between the parts adjoining or surrounding each other, it is possible to verify, before starting the game or the match, whether the toy article has been tampered with, for example by glueing the coupling piece to the handle.

The invention further pertains to a collection of a number of the toy articles as described above. Such a collection may e.g. be distributed over a (large) number of consumer products and/or be used in a game or game show.

The invention will now be explained in more detail by means of two exemplary embodiments, which are illustrated in the drawings.

Figure 1:
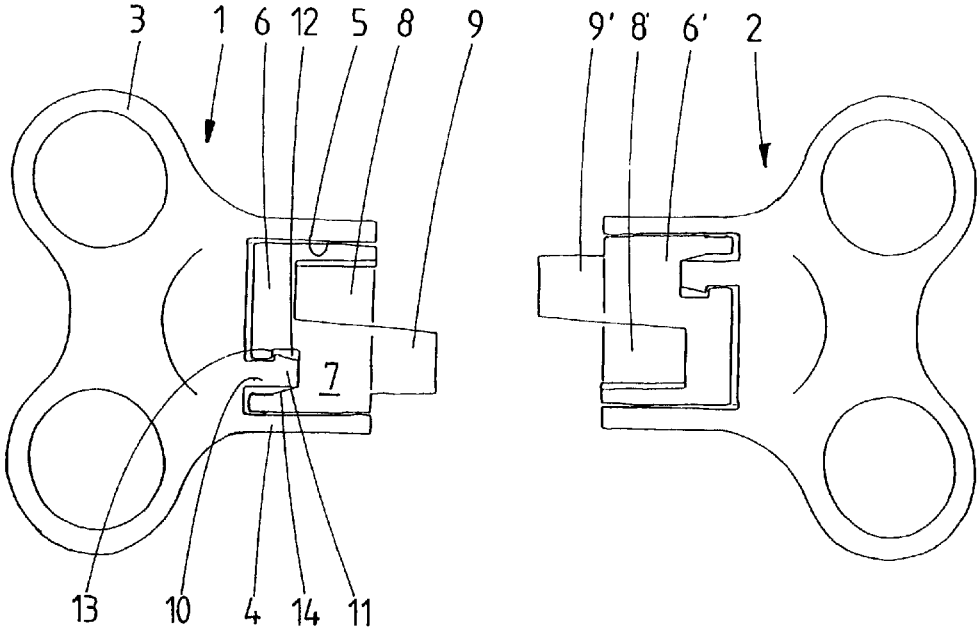
FIG. 1 shows two identical break-off keys according to the invention, just before they are coupled together.

FIG. 1 shows a first break-off key 1 and a second break-off key 2, which are fully identical to each other. Break-off keys 1, 2 comprise a handle 3, in this case in the form of a key for bleeding a central heating system. The upper side of handle 3 of break-off key 1 is flat and thin, but its thickness increases towards the lower side (to the right in FIG. 1), where it comprises a hollow cylindrical part 4 that defines a cylindrical cavity 5. A coupling piece 6 is accommodated in cylindrical cavity 5. Said coupling piece 6, which can also be called an adapter, comprises a cylindrical portion 7, whose external diameter is smaller than the internal diameter of cylindrical cavity 5. The axis of rotational symmetry of cylindrical portion 7 of coupling piece 6 (substantially) coincides with the axis of rotational symmetry of cylindrical cavity 5.

The lower side of coupling piece 6 is intended for being coupled to coupling piece 6' of the second break-off key 2. The two coupling pieces 6, 6' comprise a projection 8 and 8', respectively, and a complementary cavity 9 and 9' respectively. Break-off key 1 can be connected to break-off key 2 by inserting projection 8 into cavity 9', whereby projection 8' is simultaneously inserted into cavity 9.

Break-off key 1 furthermore comprises a connecting element or break-off pin 10, which is fixed to the bottom of cylindrical cavity 5. Break-off pin 10 includes a wedge-shaped thickening 11 at its end facing away from the bottom of cylindrical cavity 5, which thickening comprises a right-angled edge. Coupling piece 6 is furthermore provided with a recess 12 at its upper side, for receiving break-off pin 10. Recess 12 comprises a right-angled edge 13, which mates with the right-angled edge of the wedge-shaped thickening 11 so as to establish a snap connection in this manner. Establishing the aforesaid snap connection can furthermore be facilitated by providing recess 12 with a sloping wall 14.

Figure 2:
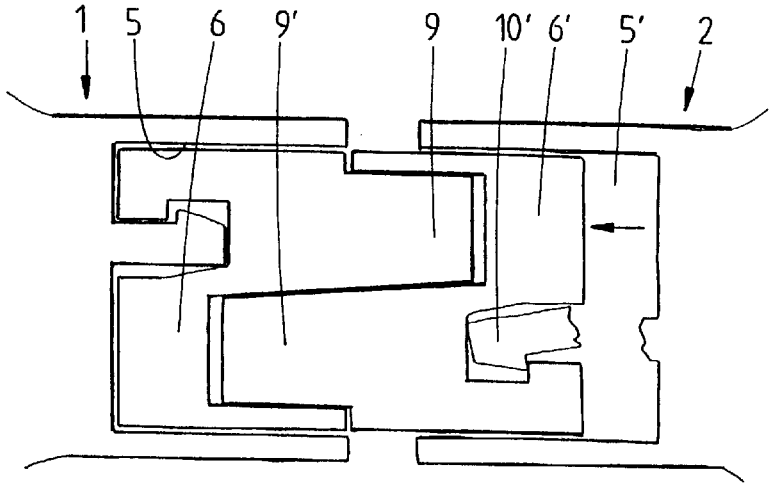
FIG. 2 is a detail view of the break-off keys according to FIG. 1, after they have been connected and one of the connecting elements has broken loose.

FIG. 2 shows the cylindrical cavities 5, 5' and the coupling pieces 6, 6' after a connection has been effected and after a torque moment has been exerted on the connection between the coupling pieces 6, 6' by means of one or both handles 3, 3'. Said torque has resulted in a force at the foot of the break-off pin 10' that exceeds the strength of said break-off pin 10' at that location. As a result, break-off pin 10' has been sheared off and break-off key 2 has been visibly and permanently damaged.

Since the projections 9, 9' are wedge-shaped, the coupling piece 6' of the second break-off key 2 remains clamped down in the coupling piece 6 of the first break-off key 1, so that the former coupling piece can be removed from the cylindrical cavity 5' by pulling break-off keys 1 and 2 apart in the direction of the aforesaid axes of symmetry.

The strength of the break-off pins 10 and 10' can be varied in several manners. For instance, the radial distance of break-off pin 10 can determine the degree to which the exerted torque is converted into a shearing force of break-off pin 10. The closer break-off pin 10 is disposed to the axis of symmetry of cylindrical cavity 5, the larger the shearing force at the foot of the break-off pin 10 resulting from the exerted torque will be, and the sooner the break-off pin 10 will give way.

The strength of the break-off pin can furthermore be adapted by varying the thickness thereof or by means of additives to the material of the break-off key, which additives undermine the properties of the material or which, on the contrary, enhance said properties. Moreover, it has become apparent in practice that break-off keys that have been produced in an identical manner and from identical materials still exhibit a significant difference in strength. This difference is probably due to manufacturing tolerances.

Figure 3A:
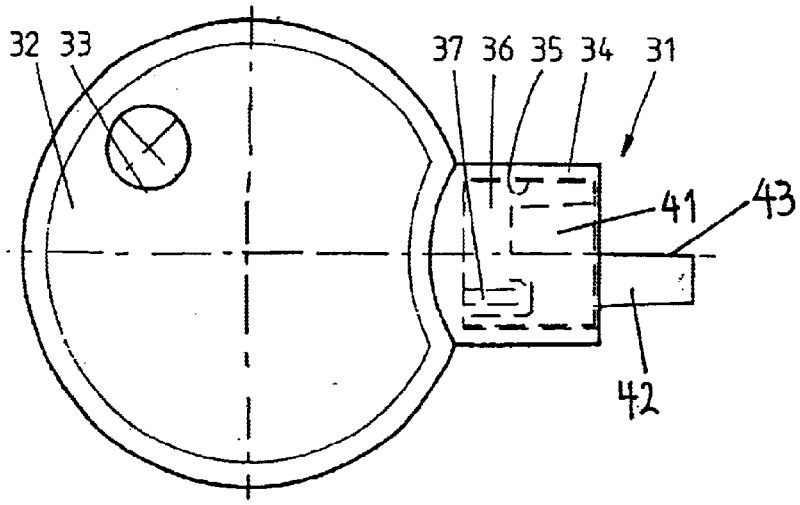
FIG. 3A is a top plan view of a second break-off key according to the invention.
Figure 3B:
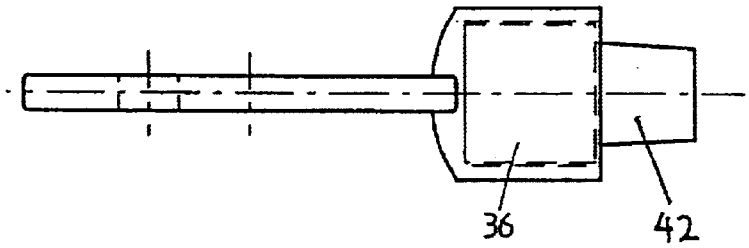
FIG. 3B is a side view of the break-off key according to FIG. 3A.
Figure 3C:
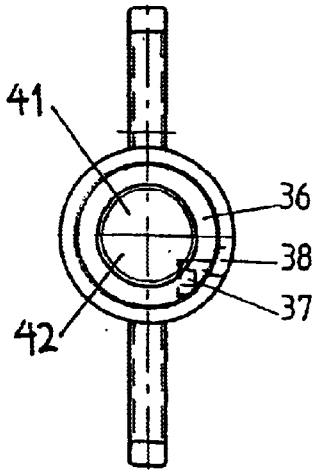
FIG. 3C is a front view of the break-off key according to FIG. 3A.

FIGS. 3A–3C show a second embodiment of the toy article according to the invention, viz. a second type of break-off key 31 comprising a disc-shaped handle 32. Disc-shaped handle 32 includes a hole 33 by means of which the user can attach one or more break-off keys 31 to a cord or a bunch of keys. In this embodiment the handle 32 has a relatively large surface area, which can be used for placing pictures or text thereon.

Also this break-off key 31 includes a hollow cylindrical portion 34, which comprises a cylindrical cavity 35. A coupling piece 36 is present in said cylindrical cavity 35, which coupling piece 36 is shaped to be able to be coupled to an identical coupling piece 36, for example of a second break-off key (not shown) that is identical to break-off key 31. In the embodiment of FIGS. 3A–3C coupling piece 36 includes a slot 41 and projection 42 having a surface 43. Projection 42 of a first coupling piece 36 fits into slot 41 of a second, identical coupling piece 36 with the surfaces 43 of projections 42 facing one another. Coupling piece 36 is connected by means of a snap connection to shear or break-off pin 37, which is present at the bottom of cylindrical cavity 35. An opening 38 is formed in the wall of hollow cylindrical portion 34, at the location of shear or break-off pin 37. A construction of this type makes it possible to produce break-off key 31 in a simple and accurate manner, since the thickness of shear or break-off pin 37 can easily be adapted in the mould in which the break-off key 31 is formed by means of a moving part in said mould. Depending on the degree to which said moving part moves inwardly, for example during an injection moulding process, the resulting shear or break-off pin 37 will be thicker or thinner and thus stronger or less strong.

The toy articles according to the invention can be made from various materials, wherein it is preferable to use plastics such as for example polyvinyl chloride, polyamide, polyester or polyolefins. It is also conceivable to use an edible material, such as sugar, for one or more parts.

The toy article according to the invention can be made in various forms and/or colours, which could for example serve as a code or an indication of the force or the torque at which the connecting element that forms part of the toy article will give way.

From the foregoing it will be apparent that the toy article according to the invention allows a great variety of games and competitions. Thus, a competition wherein the toy article is for example distributed nationwide may be considered, for example by adding the toy article to bags of crisps or boxes of cornflakes, and wherein a day is organized on which everybody who thinks he or she has a very strong specimen can participate in the finals. In addition to that the handle and/or the coupling piece of the present toy article can function as a collector's item, in particular if they are made in all kinds of special colours or if they are provided with pictures or texts. Furthermore, the toy article or a specific part thereof can function as a sort of coupon, whereby for example ten specimens can be traded for a bottle of a soft drink or a tube of toothpaste.

The handle and/or the coupling piece may be provided with a symbol, such as a letter or a pictogram. Thus, the owner of several toy articles each provided with a letter which together spell the word "BACKPACK" could be allowed to exchange the said toy articles for an actual backpack. It is preferred that the symbol is invisible as long as the connecting element is still intact.

Combinations of colors and pictures may be used to render the handles suitable as pieces in a game for which the distributor of the toy articles could provide a playing board.

The invention is not limited to the embodiments as described above and shown in the drawing, which can be varied in several ways without departing from the scope of the invention as defined in the claims.

Thus the toy article can be added to packages for crisps, cornflakes, chewing gum, washing-powder or other articles. It is also possible to affix the coupling piece to the inside of a cap of a bottle of a soft drink, whereby the cap also functions as a handle for the present toy article. It stands to reason that it is also possible to sell the toy article as such.

What is claimed is:

1. A toy article which is suitable as a collector's item or for use in games, which toy article comprises:

a) a handle, b) a coupling piece having a coupling structure that is capable of directly connecting with a substantially identical coupling structure of another toy article, and c) a connecting element which attaches said handle to said piece, which connecting element breaks when a predetermined force or torque is exerted thereon.

2. A toy article according to claim 1, wherein the coupling piece comprises a projection and a cavity that is complementary to said projection.

3. A toy article according to claim 2, wherein said projection is wedge-shaped.

4. A toy article according to claim 1, wherein said connecting element is selected from the group consisting of a shear pin and an element which comprises a shear pin.

5. A toy article according to claim 1, wherein the coupling piece is connected to the connecting element by means of a once-only snap connection.

6. A toy article according to claim 1, wherein one of the coupling piece and the handle comprises a cylindrical portion, said cylindrical portion defining a cylindrical cavity having a wall and a bottom, such that said cylindrical portion of said toy article may be movably fixed in the cylindrical cavity in the handle or in the coupling piece.

7. A toy article according to claim 6, wherein the connecting element is fixed to one of the wall and the bottom of the cylindrical cavity.

8. A toy article according to claim 1, wherein there is a certain amount of play between the coupling piece and the connecting element.

9. A toy article according to claim 1, wherein one or both of the handle and the coupling piece is provided with a symbol.

10. A toy article according to claim 9, wherein the symbol is invisible as long as the connecting element is still intact.

11. A plurality of toy articles which are suitable as collector's items or for use in games, which toy articles each comprise a handle and a coupling piece having a coupling structure that is capable of directly connecting with a substantially identical coupling structure of another of said plurality of toy articles, each said coupling piece being attached to the handle of the toy article by a connecting element, which connecting element breaks when a predetermined force or torque is exerted thereon, and wherein when at least two of said toy articles are connected and when a predetermined force or torque is exerted thereon, one of said connecting elements will break.

12. A plurality of toy articles as claimed in claim 11, wherein at least some of said connecting elements of said toy articles are designed to break upon exertion of a different predetermined force or torque thereon, than for other of said connecting elements of said toy articles.

13. A plurality of toy articles according to claim 11, wherein each said coupling piece comprises a projection and a cavity that is complementary to said projection.

14. A plurality of toy articles according to claim 13, wherein each said projection is wedge-shaped.

15. A plurality of toy articles according to claim 11, wherein each said connecting element comprises a shear pin.

16. A plurality of toy articles according to claim 12, wherein each said coupling piece is connected to each said connecting element of each said toy article by means of a once-only snap connection.

17. A plurality of toy articles according to claim 11, wherein one of the coupling piece and the handle of each said toy article comprises a cylindrical portion, said cylindrical portion defining a cylindrical cavity having a wall and a bottom, such that said cylindrical portion of each said toy article may be movably fixed in the cylindrical cavity in the handle or in the coupling piece of the toy article.

18. A plurality of toy articles according to claim 17, wherein each said connecting element is fixed to the wall or to the bottom of each said cylindrical cavity of each said toy article.

19. A plurality of toy articles according to claim 11, wherein there is a certain amount of play between each said coupling piece and each said connecting element of each said toy article.

20. A plurality of toy articles according to claim 11, wherein one or both of the handle and the coupling piece of each said toy article is provided with a symbol.

21. A plurality of toy articles as claimed in claim 20, wherein said symbol is invisible as long as the connecting element remains intact.

* * * * *